US005329897A

United States Patent [19]

Hemphill et al.

[11] Patent Number: 5,329,897

[45] Date of Patent: Jul. 19, 1994

[54] ROTARY VALVE WITH SEAL FOR INTERNAL COMBUSTION ENGINE

[75] Inventors: Jeffrey A. Hemphill, Fairlawn; Brian D. Hamphill, Painesville, both of Ohio

[73] Assignee: Renaissance Motor Works, Co., Ohio

[21] Appl. No.: 70,277

[22] Filed: Jun. 1, 1993

[51] Int. Cl.[5] ..... F01L 7/08; F01L 7/16

[52] U.S. Cl. ..... 123/190.17; 123/190.14

[58] Field of Search ..... 123/190.1, 190.14, 190.2, 123/190.17, 190.7

[56] References Cited

U.S. PATENT DOCUMENTS

| | | | |
|---|---|---|---|
| 756,160 | 3/1904 | Evanson . | |
| 1,965,642 | 7/1934 | Hall | 123/190.17 |
| 3,130,952 | 4/1964 | Meyer | 251/175 |
| 3,130,953 | 4/1964 | Carpenter | 251/182 |
| 3,362,391 | 1/1968 | Lindsay | 123/190.1 |
| 4,077,382 | 3/1978 | Gentile | 123/190.1 |
| 4,467,751 | 8/1984 | Asaka et al. | 123/190.17 |
| 4,682,574 | 7/1987 | Kreuter | 123/90.11 |
| 4,782,801 | 11/1988 | Ficht et al. | 123/190.1 |
| 4,794,895 | 1/1989 | Kruger | 123/190.17 |
| 4,813,392 | 3/1989 | Hansen | 123/190 E |
| 4,976,227 | 12/1990 | Draper | 123/190.1 |
| 4,976,232 | 12/1990 | Coates | 123/190 E |
| 5,154,147 | 10/1992 | Moroki | 123/190.17 |

*Primary Examiner*—E. Rollins Cross
*Assistant Examiner*—Erick Solis

[57] ABSTRACT

A rotary valve for an internal combustion engine comprising: a tapered valve body with a passage for flow of gas starting at one end of the taper and terminating in two places 180 degrees apart on the face of the taper; a pair of rigid seals, 180 degrees apart, which are carried by the valve body and alternately seal the opening to the combustion chamber; pressure cavities behind the pads, sealed by a flexible seal, which use the pressure of the compression stroke to bias the pad which is over the opening to the combustion chamber into contact with the area around this opening, forming a gas tight seal; and a drive shaft for rotating the valve body. A clutch is actuated intermittently by an external microcontroller to engage the drive shaft of the valve with a spinning pulley. During the moving portion of the valve cycle the intake or exhaust gases pass through the flow passage. During the stationary period of the valve cycle the compression and combustion strokes of the engine occur.

20 Claims, 3 Drawing Sheets

ROTARY VALVE WITH SEAL FOR INTERNAL COMBUSTION ENGINE

Background

1. Field of Invention

This invention relates generally to rotary intake and/or exhaust valves for an internal combustion engine and more particularly to the valve sealing technique.

2. Description of Prior Art

Rotary valves for control of induction and exhaust of gases in an internal combustion engine have several potential advantages over the currently-used poppet valves. Better gas flow characteristics, elimination of impact upon seating, and inexpensive manufacture are a few. As a result, many arrangements for implementing rotary valves exist in the field of internal combustion engines, as early as 1901 when Evenson described a method of driving a conical rotary valve in oscillatory motion in U.S. Pat. No. 756,160. Some of the difficulties encountered by the first attempts were; difficulty obtaining effective sealing, high friction opposing rotation, high wear and complex mechanical rotation mechanisms.

Later efforts concentrated on alleviating some of the friction by using a pressure activated seal which required contact of the valve and its bore or seat only during part of the engine cycle. Carpenter describes one of the earliest embodiments of this technique in U.S. Pat. No. 3,130,953 (1964) in which a split-sleeve device associated with the valve body deforms outward under compression or combustion pressure in the cylinder to seal the intake and exhaust ports. Another pressure activated seal is described by Coates in U.S. Pat. No. 4,976,232 (1990) in which the spherical valve seal is of two-piece construction to allow pressurized gases to increase the seal contact pressure.

These represented an improvement because the valve's friction to rotation was reduced for much of its motion; however, there was still a portion of the valve's rotary position in which it was in high friction contact with some type of seal while rotating. Consequently, that portion of the valve was still subject to high wear.

OBJECT AND ADVANTAGES

Accordingly, several objects and advantages of the present invention are:

(a) to provide a rotary valve for use in an internal combustion engine that has low rotational friction and good sealing capability by pressure activating the seal only when the valve is not in motion;

(b) to provide a rotary valve for use in an internal combustion engine that provides superior intake and exhaust gas flow characteristics;

(c) to provide a rotary valve for use in an internal combustion engine that allows the combustion chamber of the engine to be nearly ideally shaped;

(d) to provide a rotary valve for use in an internal combustion engine that is simple in construction and highly durable;

(e) to provide a rotary valve for use in an internal combustion engine that accommodates intermittent electromechanical actuation of the valve.

Further objects and advantages are to provide a rotary valve which, due to its method of actuation and type of motion accommodates a continuously variable timing of opening and closing points in relation to movement of the piston, which allows for elimination of the throttle plate in the intake manifold, which allows for optimum intake and exhaust of gases at any engine speed, which allows for greater power for a given displacement engine, which allows the engine to be assembled far more quickly, which reduces the number of parts in the engine, and which allows the cylinder block and head to be cast and machined as one piece. Still further objects and advantages will become apparent from a consideration of the ensuing description and drawings.

DRAWING FIGURES

In the drawings, closely related figures have the same number but different alphabetic suffixes.

REFERENCE NUMERALS AND DRAWINGS

| | | | |
|---|---|---|---|
| 10 | block/head casting | 12 | intake valve assembly |
| 12a | valve body | 12b | floating pad |
| 12c | flexible seal | 12d | pad orifice |
| 12e | flow passage | 12f | pressure cavity |
| 12g | dead stop | 12h | drive shaft |
| 12i | pocket | 12j | flow passage termination |
| 12k | chamfer and radius | 13 | exhaust valve assembly |
| 14 | drive pulley | 16 | clutch |
| 18 | drive belt | 20 | gasket |
| 22 | clutch cover | 24 | spark plug |
| 26 | coolant passage | 28 | intake manifold |
| 30 | exhaust manifold | 32 | piston and piston ring assembly |
| 34 | combustion chamber | 36 | valve bore |
| 38 | drive shaft passage | 40 | cylinder |
| 42 | flow opening | | |

DESCRIPTION–FIGS. 1 to 4

Figure 1:
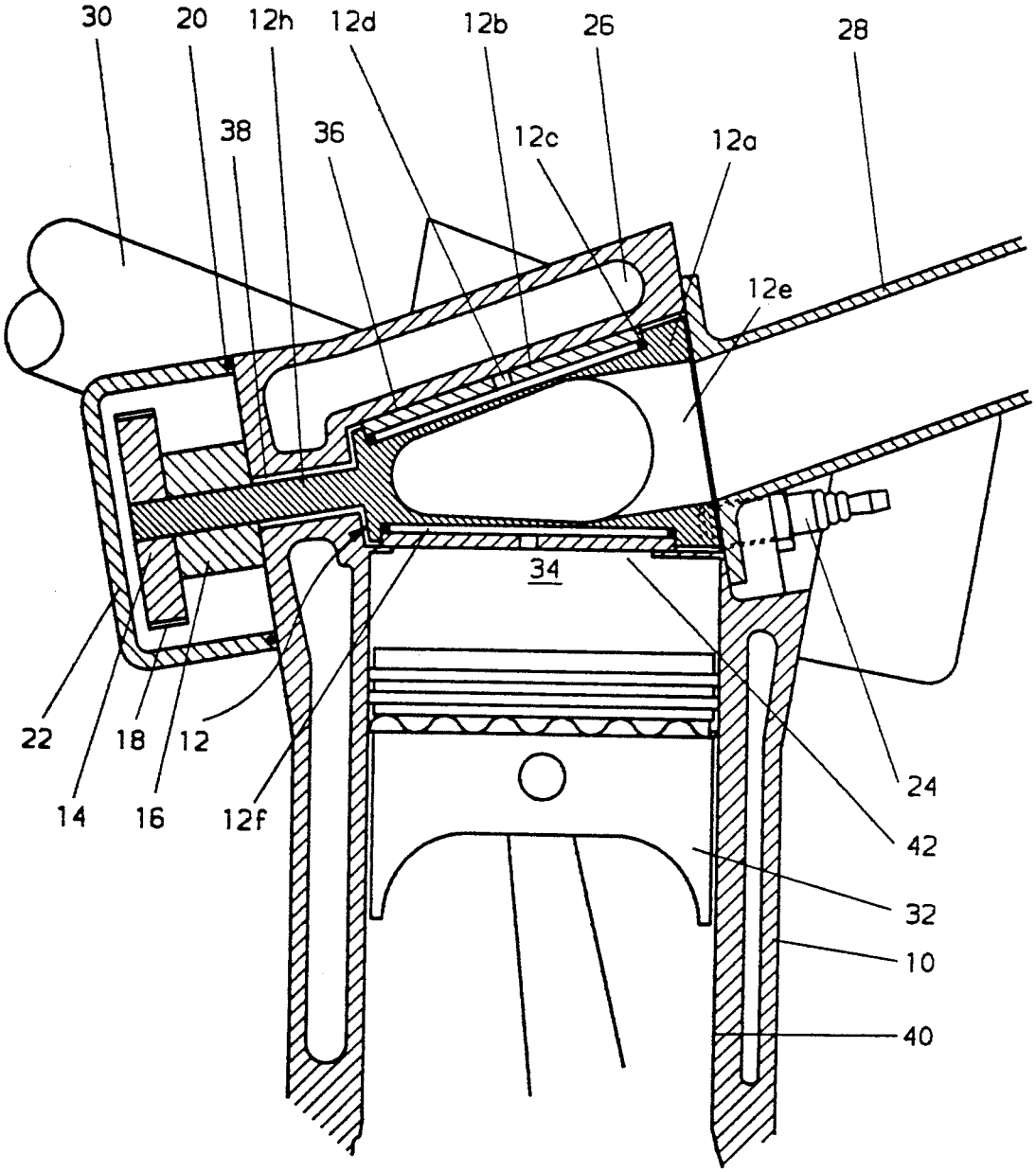
FIG. 1 shows a cross-sectional view of one cylinder with the valve, valve actuator and exhaust and intake manifolds.
Figure 2:
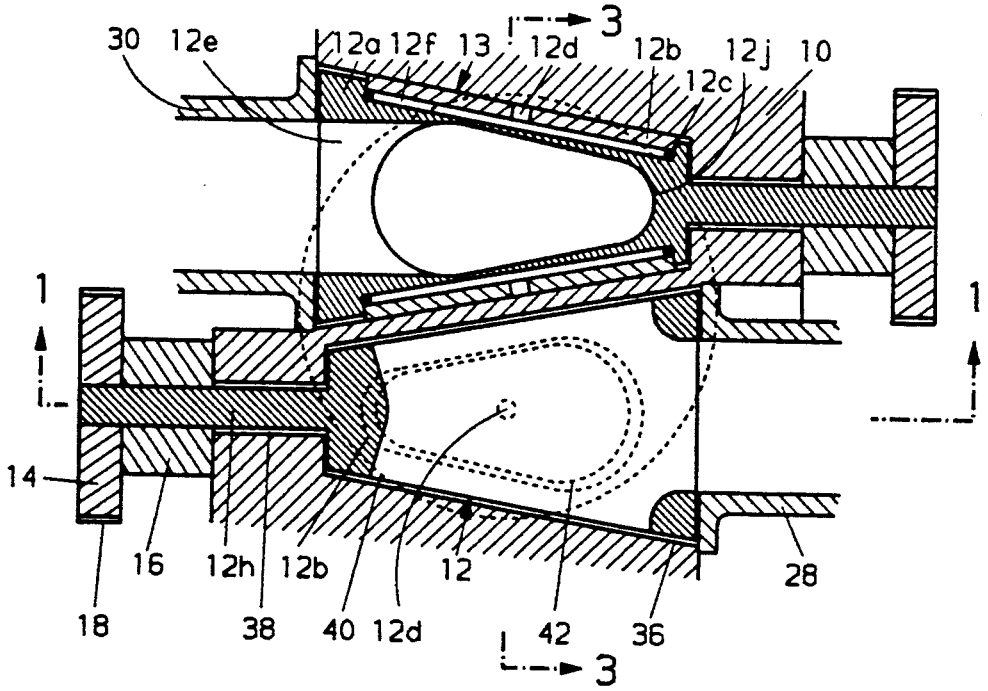
FIG. 2 shows a schematic view of the valve arrangement from above the cylinder.

A typical embodiment of the present invention is illustrated in FIG. 1. An intake valve assembly 12, shown in the closed position, and an exhaust valve assembly 13, shown in FIG. 2, are rotatably mounted in separate valve bores 36. In the following discussion, only the intake valve will be described because both valve assemblies are identical. A Piston 32 reciprocates within a block/head casting 10 in the conventional manner. A spark plug 24 protrudes into a combustion chamber 34 from the side of block/head casting 10. Alternately, two spark plugs 24 may be used at opposite sides of combustion chamber 34 to obtain better ignition of compressed fuel/air mixture. Further, an injection nozzle may be mounted at one plug location for use as a direct injection engine if desired. A coolant passage is located above valve bores 36. An intake manifold 28 and an exhaust manifold 30 bolt to block/head casting 10 in the conventional manner.

Figure 3:
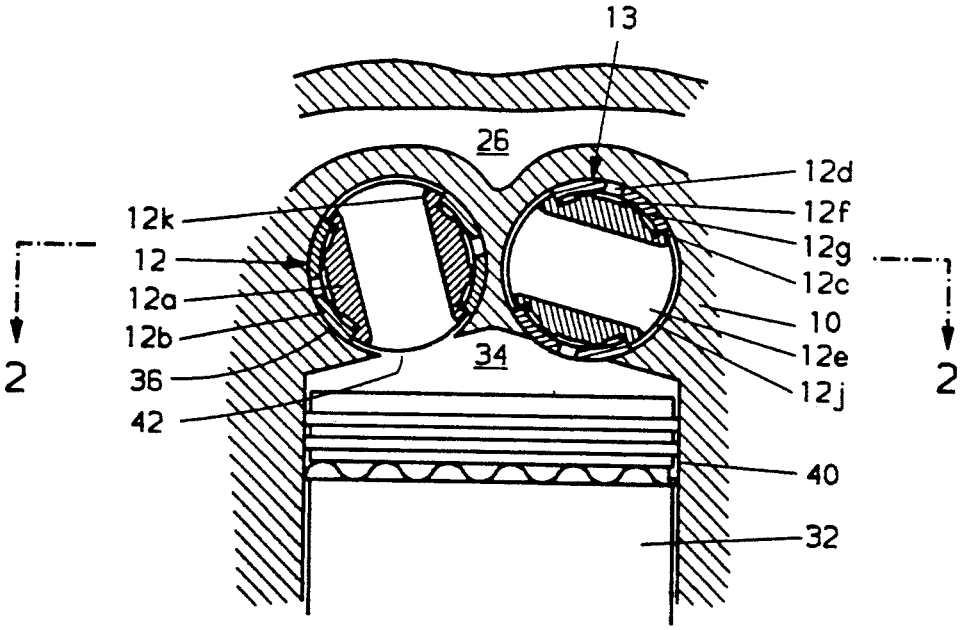
FIG. 3 shows a cross section of the valves and combustion chamber.

FIG. 3 shows combustion chamber 34 defined by the top of piston 32, the top of a cylinder 40 in block/head 10, and valves and 13. In this way, combustion chamber 34 can be seen to be of a modified pent roof type, recognized in the art as a near optimum geometry for combustion efficiency. Valve assemblies 12 and 13 consist of a valve body 12a, two identical floating rigid seals or pads 12b, and two identical flexible seals 12c.

Figure 4A:
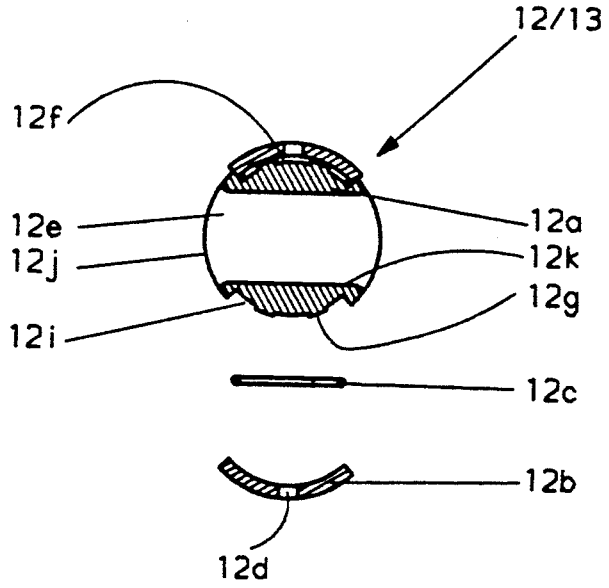
FIGS. 4A and 4B show the exploded view of the valve body and seals.

FIG. 2 shows a schematic overhead view of valves 12 and intake manifold 28 exhaust manifold 30 and two clutches 14. A drive shaft 12h protrudes from the nose of each valve body 12a, through drive shaft passages 38 and into clutches 16. Drive pulleys 14 are mounted to clutches 16 and rotated by a drive belt 18. A flow passage 12e can be seen in valve body 12a. This passage proceeds from the large end of the conical portion of valve body 12a, which abuts one of the manifold openings, through valve body 12a and out both sides of valve body 12a into flow passage terminations 12j which are 180 degrees apart and of the same shape. In this way, when one flow passage termination 12j is in registration with a flow opening 42 into combustion chamber 34, the other flow passage termination 12j is blocked by the top of valve bore 36. Chamfer and radius 12k at flow passage termination 12j allows flow passage termination 12j to be larger in square area than flow passage 12e (FIG. 4A). This arrangement can also be seen in FIG. 3, a section through valves 12 and 13, block/head 10, and piston 32.

Figure 4B:
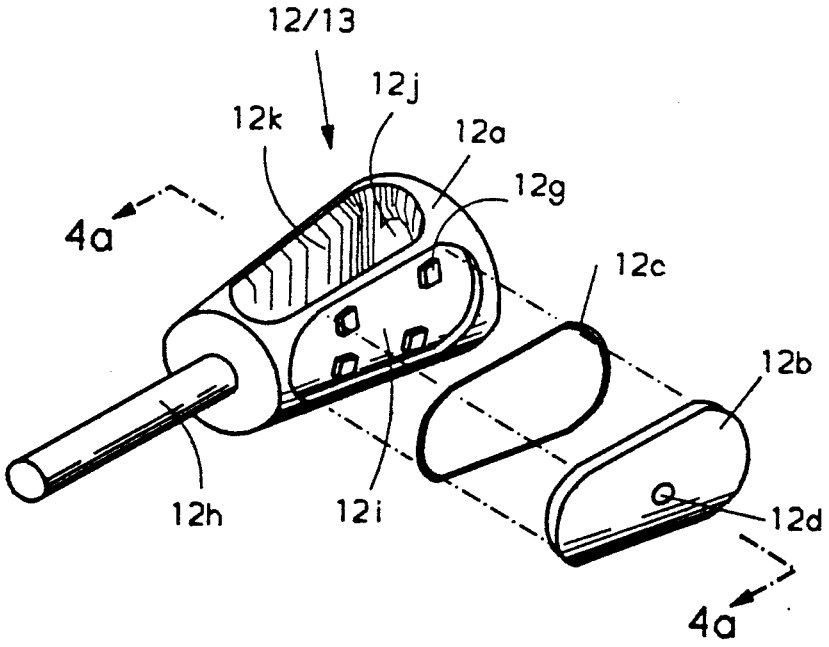

FIG. 4B shows an exploded view of valve body 12a, pads 12b and seals 12c. The same assembly is shown in section in FIG. 4A. Valve body 12a is conical in shape with cylindrical drive shaft 12h abutting the nose of the cone. The conical portion is roughly equal in length to the diameter of the cylinder. The preferred angle of the cone is 20 degrees, although in other embodiments valve body 12a can be of any geometry that has a round cross section through at least one point. Art example is a round or cylindrical geometry. Two pockets 12i, 180 degrees apart, spaced 90 degrees from flow passage termination 12j, are present on the face of tapered valve body 12a. The edges of pockets 12i follow longitudinal lines along the face of the cone and terminate in semicircles. Valve body can be constructed of a variety of materials such as aluminum, steel, bronze etc. and in some applications can also be of plastic or composites of plastic and fibers. For ease of manufacture a die casting or powder metal sintering may be used. Valve body 12a may be of one piece construction or assembled from separate components.

Pads 12b are of the same outside shape as pockets 12i and slightly smaller in dimension so as to fit within pocket 12i without binding. Pads 12b are constructed so as to form segments of a cone, said cone of same angle as valve body 12a and slightly larger in diameter. In this way, pads 12b lie slightly above surface of valve body 12a when assembled over seals 12c. On the bottom of pockets 12i are several dead stops 12g. These protrusions prevent pads 12b from moving more than a fixed distance into pockets 12i. Pads are preferably constructed of ceramic or ceramic composite, but other wear-resistant material may be used. The square area of pads 12b is greater than that of flow opening 42. Ideally the ratio of square area is 1.5:1 or greater in favor of pad 12b.

Seals 12c fit behind pads 12b and inside pockets 12i which lie along the sides of valve body 12a, forming a pressure cavity 12f which communicates alternately throughout the engine cycle with combustion chamber 34 through a pad orifice 12d. The geometry of seal 12c is the same as that of pocket 12i in outside dimension and is roughly half as thick as the depth of pocket 12i. In the preferred embodiment seal 12c is of rubber or other flexible material which can bear elevated temperature. Optionally, seal 12c can consist of a thin sheet of steel, plastic or other material and can be bonded along the edges of pad 12b so as to form a diaphragm behind pad 12b.

FIG. 2 shows drive shaft 12h protruding from the conical section of valve body 12a, through drive shaft passage 38 and to the outside of cylinder block/head casting 10 where it is press fitted into clutch 16. Drive shaft 12h transmits torque from clutch 16 into valve body 12a whenever clutch 16 is actuated. Valves 12 and 13 are supported and positioned by a bearing system composed of several parts. First, rigid pad seals 12b act as bearings within valve bore 36. Pads 12b act to bear both radial and thrust loads due to the tapered configuration of valves 12 and 13 and valve bore 36. During motion, pads 12b are riding on flexible seals 12c and are not in contact with dead stops 12g. In this way, flexible seals 12c act as springs as well as seals. The amount of preload on flexible seals 12c is determined by the distance between the clutch/block thrust bearing surface and valves 12 or 13. This flexibility allows for a slight amount of misalignment during operation. The inside face of clutch 16 bears on the outside of block/head casting 10. At this bearing surface, thrust loads which are opposite in direction to those resisted by rigid pads 12b are born. In the preferred embodiment, this bearing system is non-lubricated. Although in other possible embodiments the system may be lubricated by a low or high pressure oil system if desired. Also, additional bearings may be used within drive shaft passage 38 which may be of sleeve or ball or roller type.

Clutch 16 can be of several types: wrap-spring, hysteresis, eddy-current or friction as warranted by the application. Clutch 16 can also contain means for detenting valves 12 or 13 in one of two positions 180 degrees apart. Kinetic energy for clutch 16 is provided by drive pulley 14 which is rotated by drive belt 18. Pulley 14 and belt 18 can be of several types: chain and sprocket, perforated metal belt, round belt or flat belt. Motive power for drive belt 18 can be alternately provided by the motion of the crankshaft through a conventional belting arrangement or by a separate motor of electrical, hydraulic or pneumatic type. Use of a separate motor allows the speed of pulley 14 to be adjusted continuously throughout the engine cycle to alter the timing of open and close points of valves 12 and 13 and also the duration of valves 12 and 13 open period relative to piston 32. Clutches pulleys 14 and belt 18 are covered by clutch cover 22 sealed by gasket 20 (FIG. 1), which can run the length of a cylinder bank in multiple cylinder engine applications or be isolated around a single clutch 16. In other embodiments, clutch 16, pulley 14, and belt 18 can be replaced by an independent actuator of hydraulic, pneumatic, or electromechanical type.

Valve bore 36 is machined from block/head casting 10 and may be coated with any of several durable coatings such as nickel, chrome or other coatings which are well known in the field. Optionally, valve bore 36 may be lined with cast iron or hardened steel to increase its resistance to wear. Valve bore 36 includes flow opening 42 which communicates with combustion chamber 34 and is equal in size and shape to the flow passage termination 12j in the side of valve body 12a. Block/head casting 10 can be of one piece construction due to the fact that no machining inside the combustion chamber is required because of the valve geometry. This eliminates several machining and assembly steps and several parts over the current engine designs which utilize a separate head. It further improves reliability of the engine by eliminating several gaskets and joints.

OPERATION

In the preferred embodiment the valves 12 and 13 are used in a 4-cycle, reciprocating piston engine. They also, however, can be used in a diesel engine, two-stroke engine, rotary engine or compressor as warranted. Referring to FIG. 1, at the start of the intake cycle, intake valve assembly 12 is positioned with pad 12*b* over flow opening 42 into combustion chamber 34. As piston 32 nears the top of its stroke, clutch 16 is activated by a conventional external microcontroller. This microcontroller can be one of many different types of microcontrollers known in the art and can be capable of adjusting the point in the cycle at which valve motion begins and ends. Clutch 16 engages drive shaft 12*h* with drive pulley 14 and causes intake valve 12 to rotate. After a brief period of acceleration, normally 0.001–0.003 seconds, intake valve 12 is moving at the same speed as drive pulley 14. The speed of drive pulley 14 thus controls the amount of time for intake valve 12 to index from open to closed positions and hence the duration of the intake or exhaust period. Clutch 16 is released by the microcontroller at a point which will bring the valve to rest 180 degrees from its original position, with pad 12*b* centered over flow opening 42. Note that during the subsequent engine cycle the pads 12*b* will switch position. The pad 12*b* which last covered flow opening 42 will be resting against the top of valve bore 36. This area of valve bore 36 is well cooled by coolant passage 26. This alternating sequence allows pads 12*b* to be cooled periodically, reducing hot spots in combustion chamber 34. As piston 32 moves down cylinder 40, air and vaporized gas are drawn in to combustion chamber 34 from intake manifold 28 through flow passage 12*e* as intake valve 12 is in motion with flow passage 12*e* passing over flow opening 42. Chamfer and radius 44 (FIG. 4*a*) lengthens the amount of time that flow passage 12*e* is in communication with flow opening 42. Vaporized gas can be provided by a fuel injection nozzle in intake manifold 28, by a carburetor or by direct injection from a nozzle into combustion chamber 34. Timing is controlled such that the valve achieves its stopped position with pad 12*b* over flow opening 42 just as pressure in intake manifold 28 is nearly equal to pressure in combustion chamber 34. This point is normally reached just after piston 32 starts to move back up cylinder 40 as it begins to push air/fuel mixture toward intake manifold 28.

Piston 32 continues to move up and beings to pressurize the air/fuel mixture in combustion chamber 34. As pressure rises, gases are forced through pad orifice 12*d* and into pressure cavity 12*f* behind pad 12*b*. This pressure is trapped by seal 12*c* and forces pad 12*b* against flow opening 42. The amount of force present is dependant on the ratio of areas of flow opening 42 and pad 12*b*. Due to the force present, pad 12*b* forms a gas tight seal over flow opening 42 and allows compression of the air/fuel mixture. Also due to this force, valve body 12*a* is forced upward within valve bore 36. This causes deadstops 12*g* to come in contact with pad 12*b* which is in the upper position. This slight motion allows pad 12*b* to transfer the force of sealing combustion chamber 34 into the top of valve bore 36. At this point in the cycle, neither intake valve 12 or exhaust valve 13 is in motion. Just before piston 32 reaches the top of its stroke, spark plug 24 is activated. Spark plug 24 may be activated by an independent microcontroller or by the same microcontroller which times the motion of valves 12 and 13. The spark causes ignition of the air/fuel mixture within combustion chamber 34. The burning gases increase the pressure within combustion chamber 34 and force piston 32 back down cylinder 40. As piston reaches the bottom of its stroke, the controller actuates clutch 16 for exhaust valve which is in communication with the exhaust manifold. The point within the pistons travel at which this happens is determined by the microcontroller and can be based on one or many monitored factors such as engine speed. After a brief period of acceleration exhaust valve 13 is moving at the same speed as drive pulley 14. During the motion of exhaust valve 13, piston 32 begins to move up in cylinder 40. As flow passage 12*e* passes flow opening 42, spent gases are forced out through flow passage 12*e* and into exhaust manifold 30. The speed of drive pulley 14 is adjusted such that exhaust valve 13 will complete 180 degrees of motion sometime after piston 32 passes the top of its stroke. The speed of drive pulley 14 can be fixed in relation to engine speed by having drive belt driven through conventional pulleys or sprockets at a ratio of approximately 1:1.25 of engine speed. This creates a valve open duration of approximately 220 degrees of crankshaft motion Alternately, drive belt 18 may be driven by an independent motor or by a variable ratio pulley arrangement from the crankshaft to allow the duration of open time to be adjusted by the microcontroller. As piston 32 approaches the top of its stroke, the microcontroller actuates clutch 16 which drives intake valve 12. For a brief period of time, both valves 12 and 13 are in motion. This is the overlap period, the length of which can be controlled by the microcontroller. Shortly after the piston begins to descend on the intake stroke, exhaust valve 13 is disengaged from clutch 16 and allowed to come to rest with pad 12*b* centered over flow opening 42. At this point the 4-cycle process begins again.

SUMMARY, RAMIFICATIONS AND SCOPE

Accordingly, the reader will see that the valve assembly of this invention can easily be incorporated into a 4 cycle internal combustion engine of the reciprocating piston type. In such an engine, the valve allows for easy control by a microprocessor. Such control allows the valve timing to be adjusted continuously based on engine speed, required horsepower, atmospheric pressure or almost any other factor which can be monitored or adjusted by the operator of the engine. The valve also allows for an improved flow situation over currently used poppet valves since since there are no obstructions in the flow passage. These two advantages allow for significantly greater power per cubic inch of engine displacement, which in turn allows for a lighter engine, greater fuel efficiency and more flexibility while in operation. Furthermore, the valve has additional advantages in that:

- it allows the cylinder block and head to be machined from one casting, which eliminates many parts and assembly and machining steps over current methods;
- it eliminates the possibility of the valves interfering with the piston during an engine malfunction and the damage that can occur in such situations;
- it allows for an engine with less height since no actuating mechanisms are necessary above the valves as is the case with poppet valves. This allows for a lower hood line and center of gravity in a vehicle. These factors improve vehicle aerodynamics and handling;

it reduces the number of parts in the engine in relation to existing schemes which improves reliability and reduces costs;

it lends itself to manufacture using powder metallurgy which is very cost effective;

the valve is not in motion while it is under pressure which reduces wear on the valve and valve bore;

proper control by the microprocessor allows for lower emissions overall since the amount of fuel indrawn can be properly suited to engine speed which reduces the amount of unburned hydrocarbons in the exhaust;

use of a microprocessor allows for selection of either high horsepower or high fuel economy as desired by the operator of the engine.

Although the description above contains many specificities, these should not be construed as limiting the scope of the invention but as merely providing illustrations of some of the presently preferred embodiments of this invention. For example, the valve can be used in other machines such as compressors, rotary engines, two-cycle engines, or alternative fuel engines; the valve can be cylindrical or spherical in shape; the pad can be replaced by a section of the valve body of thin cross section, a pocket behind it, and a hole in it so as to be deformed by pressure and reduce the number of parts; etc.

Thus the scope of the invention should be determined by the appended claims and their legal equivalents, rather than by the examples given.

We claim:

1. A rotary valve for use in an internal combustion engine comprising:

a valve bore, said bore located between a combustion chamber and a manifold, said combustion chamber having at least one opening into said valve bore and said manifold having at least one opening into said valve bore, said combustion chamber having an interior surface;

b) a valve body containing a flow passage, said flow passage having at least two ends, said flow passage providing intermediate communication between said opening in said combustion chamber and said opening in said manifold, said valve body having an outer surface, at least one portion of said outer surface configured to seal said opening to said combustion chamber and to form a substantially continuous surface with said interior surface of said combustion chamber when covering said opening to said combustion chamber, said portion of said outer surface of said valve body mounted so as to allow relative motion between said portion of said outer surface of said valve body and said valve body along radial lines from the axis of rotation of said valve body, said valve body rotatably mounted in said valve bore;

c) a gas tight pocket located between said portion of said outer surface of said valve body and said axis of rotation of said valve body, the square area of which is larger than the square area of said opening to said combustion chamber on parallel sections taken perpendicular to a radial line from said axis of rotation of said valve through the centroid of said opening to said combustion chamber;

d) means for allowing said combustion chamber to communicate with said gas tight pocket when said portion of said outer surface of said valve body is stationary and positioned over said opening to said combustion chamber;

e) means for transmitting torque to said valve body.

2. The valve as recited in claim 1, wherein: said valve body is in the shape of a tapered cylinder, said tapered cylinder having a tapered wall and a large and small end, with said large end of said tapered cylinder abutting said manifold and containing one said end of said flow passage that communicates with said manifold, at least one other said end of said flow passage terminating on said tapered wall of said tapered cylinder and able to register with said opening to said combustion chamber, a drive shaft abutting said small end of said tapered cylinder.

3. The valve as recited in claim 1, wherein: said means for transmitting torque consists of an electrically actuated clutch.

4. The valve as recited in claim 1, wherein: said opening to said combustion chamber is oval or oblong.

5. The valve as recited in claim 1, further comprising: means for adjusting the timing of the application of torque to said valve.

6. The valve as recited in claim 1, wherein: said gas tight pocket is configured to prevent motion of said portion of said outer surface of said valve body toward said axis of rotation of said valve body beyond a predetermined point.

7. The valve as recited in claim 1, wherein: said portion of said outer surface of said valve body is divided into two or more equal areas symmetrically spaced around said outer surface of said valve body which protrude above said outer surface of said valve body and act to support said valve body and said clutch or a portion thereof, both during motion and while stationary.

8. The valve as recited in claim 1, wherein: said portion of said outer surface of said valve body is separate from said valve body in the form of a floating pad, said floating pad having an inner and outer surface, said outer surface of said floating pad of substantially the same shape as said outer surface of said valve body, said inner surface of said floating pad facing said axis of rotation of said valve body, a diaphragm of thin material bonded thereto, which acts to seal said gas tight pocket.

9. The valve as recited in claim 1, wherein: said means for communicating with said combustion chamber consists of a hole through said portion of said outer surface of said valve body, where the diameter of said hole is substantially smaller than the area of said opening to said combustion chamber.

10. The valve as recited in claim 1, wherein: said portion of said outer surface of said valve body is separate from said valve body in the form of a floating pad, said floating pad having an inner and an outer surface, said outer surface of said floating pad of substantially the same shape as said outer surface of said valve body, said inner surface of said floating pad facing said axis of rotation of said valve body, a flexible ring interposed between said inner surface of said floating pad and said valve body, which acts to seal said gas tight pocket.

11. The valve as recited in claim 1, wherein: the cross sectional area of said flow passage increases as said flow passage approaches said surface of said valve body, so as to allow one said end of said flow passage which is capable of registering with said opening to said combustion chamber to remain in registration with said opening to said combustion chamber before and after said opening to said combustion chamber coincides with said end of said flow passage.

12. A method for controlling the flow of gases into and out of a combustion chamber of an internal combustion engine, said combustion chamber having an inside surface, comprising:

a) rotating a valve body of round cross-section, said valve body having an outer surface, said valve body containing a flow passage, said flow passage having at least two ends, in order to align said flow passage with openings to a manifold and a combustion chamber and allowing gas to flow through said flow passage;

b) stopping the rotation of said valve body when a portion of said outer surface of said valve body which is configured for sealing and which forms a substantially continuous surface with said interior surface of said combustion chamber when sealing said opening to said combustion chamber and is able to move in relation to said valve body along a radial line from the axis of rotation of said valve body, is aligned with said opening to said combustion chamber at a predetermined point;

c) allowing pressure to equalize between said combustion chamber and a cavity located between the axis of rotation of said valve body and said portion of said outer surface of said valve body;

d) utilizing said pressure to force said portion of said outer surface of said valve body into tight contact with said opening to said combustion chamber;

e) again aligning said flow passage with said manifold and said opening to said combustion chamber and repeating the cycle.

13. The method of claim 12, wherein: said valve is rotated by alternately actuating and releasing clutches.

14. The method of claim 12, wherein: the timing of the rotation of said valve is adjusted while the engine is operating.

15. The method of claim 12, wherein: said portion of said outer surface of said valve body is made separate from said valve body in the form of a floating pad, said floating pad having an inner and outer surface, and is prevented from moving towards said axis of rotation of said valve by the configuration of said cavity.

16. The method of claim 15, wherein: said cavity is allowed to communicate with said combustion chamber through a hole in said floating pad, said hole of substantially smaller area than said opening to said combustion chamber.

17. The method of claim 15, wherein: said cavity is caused to be sealed by the presence of a thin diaphragm which is bonded to said inner surface of said floating pad.

18. The method of claim 15, wherein: at least two of said floating pads equally spaced around said outer surface of said valve body act to support said valve body is in motion and when said valve body is stationary.

19. The method of claim 12, wherein: said valve is in the shape of a tapered cylinder, said tapered cylinder having a tapered wall, and a large and a small end, with said large end of said tapered cylinder abutting said manifold and containing one said end of said flow passage that communicates with said manifold, at least one other said end of said flow passage terminating on said tapered wall of said tapered cylinder and able to register with said opening to said combustion chamber, a drive shaft abutting said small end of said tapered cylinder.

20. The method of claim 12, wherein: the cross sectional area of said flow passage is increased as said flow passage nears said outer surface of said valve body in order to allow said flow passage to communicate with said opening to said combustion chamber for a larger angular displacement of said valve body.

* * * * *